United States Patent [19]

Blümle

[11] Patent Number: 4,666,145

[45] Date of Patent: May 19, 1987

[54] SUCTION ROLLER

[75] Inventor: Martin Blümle, Horhausen, Fed. Rep. of Germany

[73] Assignee: Winkler+Dunnebier Maschinenfabrik und Eisengiesserei GmbH & Co. KG, Neuwied, Fed. Rep. of Germany

[21] Appl. No.: 785,735

[22] Filed: Oct. 9, 1985

[30] Foreign Application Priority Data

Oct. 26, 1984 [DE] Fed. Rep. of Germany ..... 3439211

[51] Int. Cl.[4] ..... B65H 5/02; B65H 5/04; B65H 5/22

[52] U.S. Cl. ..... 271/276; 271/5; 271/11; 271/90; 271/108; 271/112; 271/194

[58] Field of Search ..... 271/5, 11–15, 271/20, 90, 94, 96–99, 104, 106, 108, 112, 132, 194–196, 276

[56] References Cited

U.S. PATENT DOCUMENTS

| | | | |
|---|---|---|---|
| 3,086,771 | 4/1963 | Goin et al. | 271/94 |
| 4,052,050 | 10/1977 | Carter | 271/276 |
| 4,202,542 | 5/1980 | Lammers et al. | 271/196 |
| 4,390,174 | 6/1983 | Veith | 271/108 |
| 4,437,659 | 3/1984 | Caron et al. | 271/196 |
| 4,462,745 | 7/1984 | Johnson et al. | 271/94 |

*Primary Examiner*—Douglas C. Butler
*Attorney, Agent, or Firm*—Collard, Roe & Galgano

[57] ABSTRACT

In a suction roller for a paper processing machine of the type having at least one supply passage leading to a control head disposed at an end face, the improvement which includes the suction opening being a suction slit. The suction roller may have an insert disposed in a recess at the periphery of the roller, the insert having a side surface cooperating with the recess to define a suction slit.

11 Claims, 4 Drawing Figures

40
6
8
11
10
7
29
28
2
1

2
5
12
7
10
14
6
13
9
23
40
24
26
28
27
29
25

SUCTION ROLLER

BACKGROUND OF THE INVENTION

This invention relates to a suction roller for a paper processing machine. More particularly, it relates to a suction roller having at least one suction opening at its periphery and at least one supply passage leading to a control head disposed at an end face.

Suction rollers of this type are known in various configurations. They take up paper blanks, alter the transport direction, and finally release them. The paper blanks are held onto the suction roller by atmospheric air pressure, with a reduced pressure periodically created in the interior of the suction roller. The exact control of this reduced pressure, which must be alternately created and then eliminated with each rotation of the suction roller, is important. The extremely rapidly occurring changes of pressure necessitate a high expenditure of energy and also produce sound waves which are perceived as disruptive noise.

Accordingly, it is an object of the invention to provide an improved suction roller which uses a reduced amount of energy in generating the sub-atmospheric pressure required for its operation and, simultaneously, to lower the operating noise level of the suction roller.

SUMMARY OF THE INVENTION

Certain of the foregoing and related objects are readily attained by a suction roller for a paper processing machine of the type having at least one suction opening at the periphery and at least one supply passage leading to a control head disposed at an end face, wherein the roller has a suction slit instead of a plurality of suction openings, as in the prior art. The width of the suction slit must be very small, even with a long suction slit, to achieve the desired energy saving and noise reduction. Regardless of the suction slit length, its width also determines the required energy consumption for the production of the necessary reduced pressure, or partial vacuum within the roller.

In order to obtain a suction slit of any desired length but with extremely small width in a suction roller, a recess is provided at the periphery or the cylindrical surface of the suction roller. The recess serves to accommodate an insert. The two long longitudinal edges of the suction slit are thus preferably formed on one side by a boundary wall of the recess in the suction roller and, on the other side, by a side surface of the insert. The boundary wall of the recess and the surface of the insert may be precisely manufactured with simple means. In this manner, it is possible to produce a slit shape, and particularly a slit width, within very narrow tolerances, completely independent of the length of the suction slit. Production of a suction slit having a width on the order of fractions of a millimeter is therefore possible.

Preferably, the insert is strip shaped and forms the longitudinal edges of two suction slits with its two side surfaces. Most desirably, a special supply passage is associated with each of the two suction slits. The supply passage may be formed by a suitably shaped insert, cooperating with the base surface or the lateral boundary surfaces of the recess.

The use of a suction slit instead of suction openings, i.e. holes, achieves a considerable energy reduction and a marked lowering of the noise level. However, the noise level can be further reduced if a noise-absorbing material, e.g. asbestos or a material with a noise-attenuating surface, e.g., aerated plastics is arranged on the control head before the aperture in the direction of rotation of the roller. Preferably, the noise reducing element is a sintered material, e.g., sintered globules of brass. Most desirably, the noise attenuating plate has a groove broadening in a wedge-shaped manner towards the aperture. This noise-absorbing element leads to a considerable reduction of the noise level during pressure equalization.

Other objects and features of the present invention will become apparent from the following detailed description considered in connection with the accompanying drawings, which disclose one embodiment of the invention. It is to be understood that the drawings are to be used for the purpose of illustration only, and not as a definition of the limits of the invention.

BRIEF DESCRIPTION OF THE DRAWING

In the drawings, wherein similar reference characters denote similar elements throughout the several views.

DETAILED DESCRIPTION OF THE PREFERRED EMBODIMENT

Figure 1:
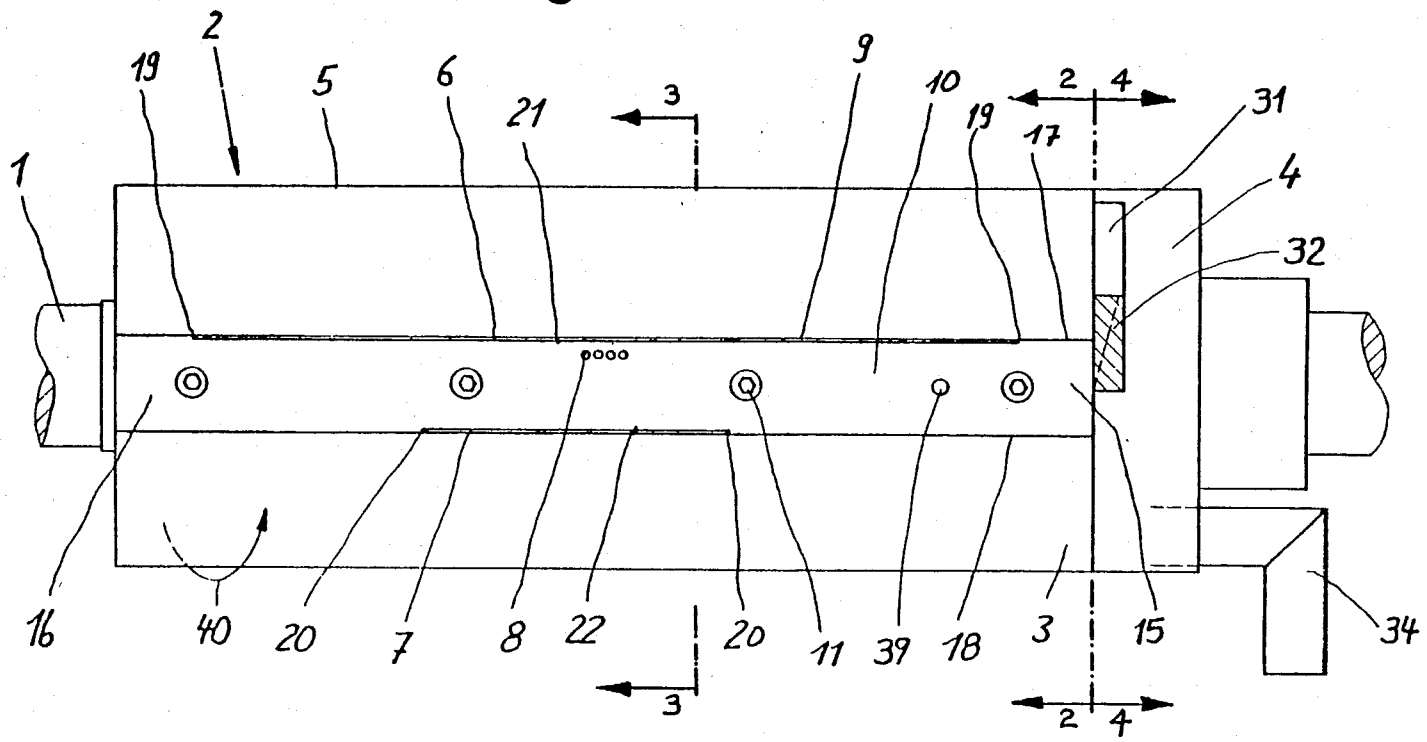
FIG. 1 is a front elevational view of the suction roller according to the invention.

Turning now in detail to the appended drawings and, as particularly shown in FIG. 1, a suction roller 2 is fixedly disposed on a shaft 1 and rotatably connected at one end 3 to a control head 4. Via mounting means 36, control head 4 is mounted on shaft 1 so as to be angularly or rotatably adjustable. In operation, roller 2 and shaft 1 rotate in the direction of rotation 40 while the control head is stationary and is held in a fixed position via control head mounting 37, screws 38, (FIG. 4) and an attaching means (not illustrated). At its cylindrical periphery 5, suction roller 2 has at least one, but preferably two, suction slits 6 and 7. Suction holes 8 can additionally be provided at the periphery 5 of suction roller 2.

Figure 2:
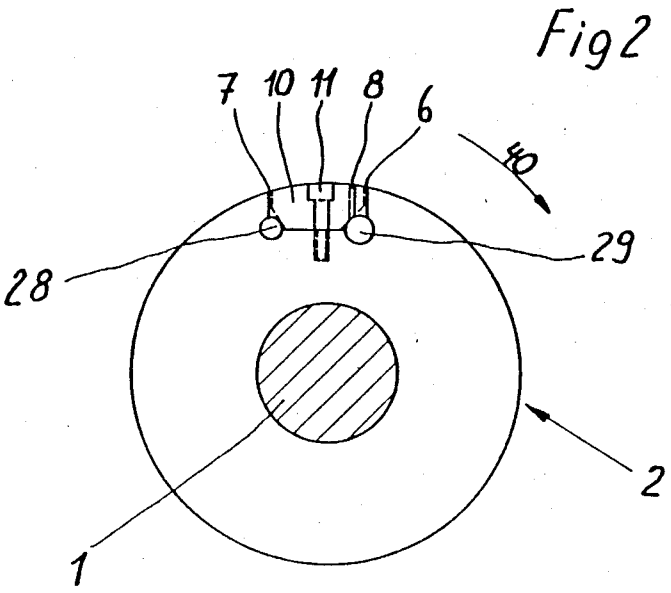
FIG. 2 is a sectional view taken along line II—II of FIG. 1.

Each suction slit 6 and 7 has a defined length which is conveniently adapted to the format of the paper blank to be transported. If either of the suction slits 6, 7 is too long, it may be shortened as desired by using an adhesive strip. As seen best in FIGS. 2 and 3, suction slits 6, 7 are formed by a recess 9 in the periphery of suction roller 2 and an insert 10 which is inserted into recess 9 and is secured therein, e.g., by means of screws 11 and locking means 39.

Figure 3:
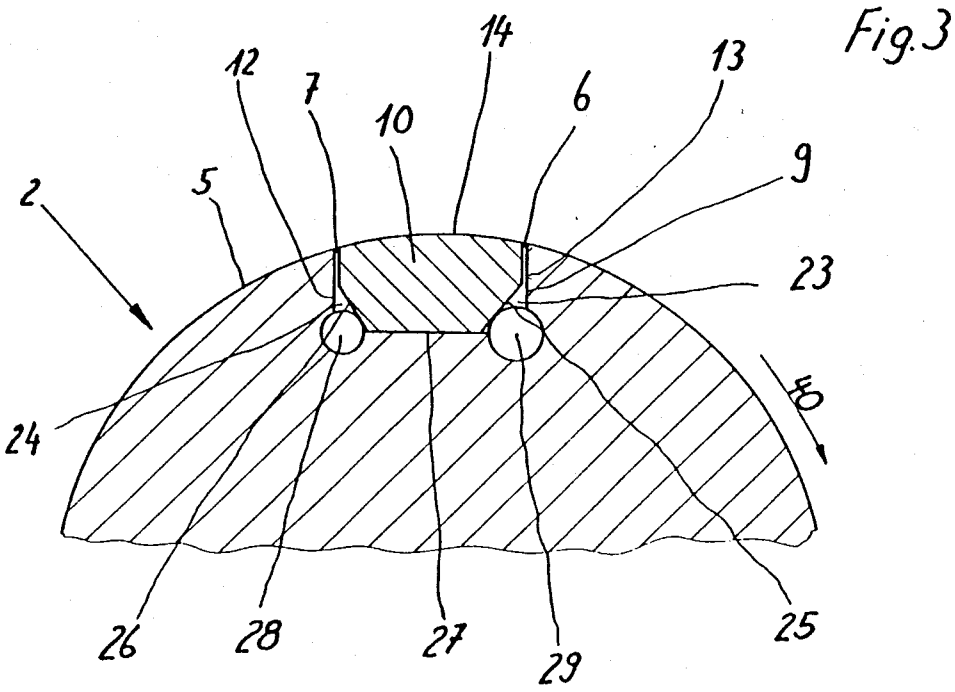
FIG. 3 is a fragmentarily-illustrated sectional view taken along line III—III of FIG. 1 at an enlarged scale.

As seen best in FIG. 3, recess 9 conveniently has parallel sidewalls 12 and 13, and has a width such that insert 10 may be exactly inserted into it. Insert 10 is strip shaped and extends e.g., over the entire length of recess 9 or suction roller 2. The contour of the periphery or round surface of suction roller 2 is further continued directly on the external surface 14 of insert 10, so that the cylindrical shape of suction roller 2 is not interrupted by insert 10.

Insert 10 fits essentially in a form-sealing manner into the recess 9, as is shown in FIG. 1, so as to reduce vacuum leakage through the interface between the sidewalls 12, 13 of recess 9, and the sidewalls 17, 18 of the insert 10. Above all, the ends 15, 16 of the strip-shaped insert 10 preferably fit exactly and without play in the peripheral or rotational direction of the suction roller 2 into the recess 9. The sidewalls 17 and 18 of insert 10 engage the sidewalls 12 and 13 of recess 9 in the region of its ends 15 and 16.

To produce the slit width of suction slits 6, 7, sidewalls 17 and 18 of insert 10 have step-like ledges or shoulders 19 and 20 defining side surfaces 21 and 22, respectively, which are recessed with respect to the sidewalls 17 and 18. The height of the ledges 19, 20 and thus the slit width of suction slits 6, 7 can be as small as desired. To produce suction slits 6, 7, it is only necessary to remove sufficient material from sidewalls 17 and 18 of insert 2 until the desired slit width has been achieved.

Suction slits 6, 7 are thus formed by a sidewall 12 or 13 of recess 9 and by a recessed side surface 21 or 22 of insert 10 with recessed surfaces 21 and 22 meeting sidewall 17 or 18, respectively, preferably at a shoulder 19 or 20 respectively. Recessed surfaces 21 or 22 directly oppose sidewalls 12 or 13 of recess 9.

Each suction slit 6, 7 is connected to a supply passage 23, 24, respectively (FIG. 3), which extends over the entire length of strip shaped insert 10. It is particularly advantageous if supply passages 23, 24 are formed by a bevelling 25, 26 on the bottom side of insert 10. Suction slits 6, 7 thus adjoin their associated supply passage 23, 24, respectively, over their entire length. Supply passages 23, 24 are therefore defined by portions of sidewalls 12, 13 and of the base 27 of recess 9 as far as bevellings 25, 26 extend.

Finally, the openings or bores 28, 29 can extend over the length of supply passages 23, 24. Bores 28, 29 are disposed in the corner on the sides of recess 9, as is shown primarily in FIGS. 2 and 3. They preferably extend beyond sidewalls 12, 13 or base surface 27.

Openings or bores 28, 29 are at least necessary adjacent to the control head since they cooperate here not only with the suction air control passage 30, which is connected via bore 35 and suction air connection 34 to a suction air or vacuum source (not shown), but also with an aperture 31 in the control head 4 which takes care of the atmospheric pressure equalization.

Figure 4:
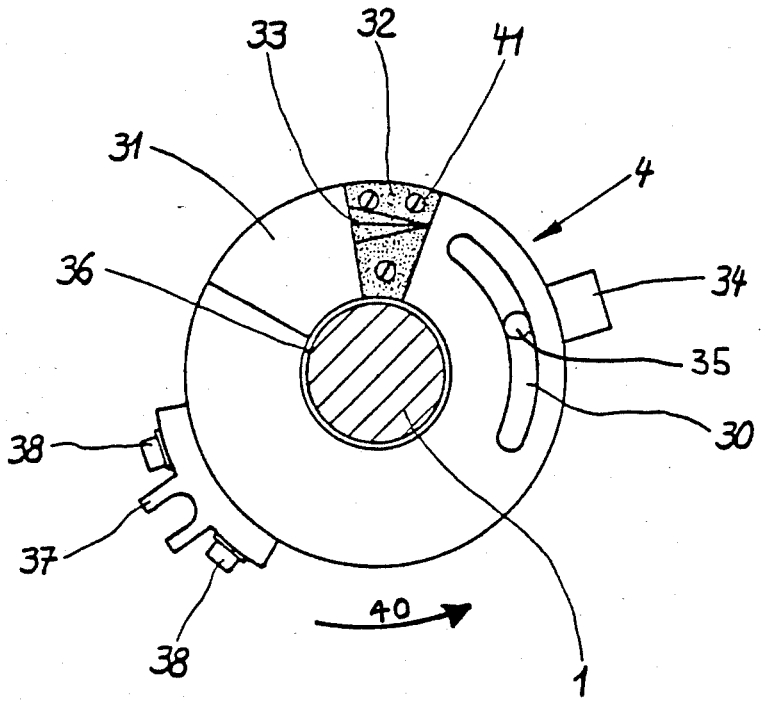
FIG. 4 is a sectional view taken along line IV—IV of FIG. 1.

As shown in FIG. 4, positioned behind suction air control passage 30 in the direction of rotation is an attenuating plate 32 which has a recess 33 broadening in a wedge-like manner towards aperture 31. Attenuating plate 32 is secured by means of screws 41 onto control head 4. Attenuating plate 32 and recess 33 serve to reduce noise during pressure equalization. They ensure that the pressure equalization does not occur instantaneously, but rather somewhat continuously and gradually. Recess 33 is situated in the end surface of attenuating plate 32 directed towards suction roller 2, as shown in FIG. 4.

As previously discussed and illustrated, suction slits 6, 7 are produced as recesses, preferably in the sidewalls 17, 18 of strip-shaped insert 10. However, they could also be produced as recesses in sidewalls 12, 13 of recess 9. Strip 10 can also have suction holes 8 at desired positions, as shown in FIG. 1. Suction holes 8 are connected (in a manner not shown) via bores to supply passages 23, 24.

Thus, while only one embodiment of the present invention has been shown, it is obvious that many changes and modifications may be made thereunto, without departing from the spirit and scope of the invention.

What is claimed is:

1. In a suction roller for a paper processing machine of the type having at least one suction opening at its periphery and at least one supply passage leading to a control head at an end face, the improvement comprising said suction roller having a longitudinal recess formed therein communicating with said at least one supply passage which extends over the entire length of said recess and a strip shaped insert having a side surface disposed in said recess, the side surface of said insert cooperating with said recess to define a suction slit forming said at least one suction opening which communicates with said at least one supply passage over the entire length of said slit.

2. The suction roller as described in claim 1, wherein said insert has two side surfaces cooperating with said recess to define two suction slits.

3. The suction roller as described in claim 2, wherein said insert has two bevelled edges defining in part two supply passages, each of said supply passages associated respectively with one of said two suction slits.

4. The suction roller as described in claim 1, wherein said insert has a bevelled edge defining in part a supply passage.

5. The suction roller as described in claim 4, wherein said supply passage defines an opening at its end adjacent to the control head.

6. The suction roller as described in claim 5, wherein said opening is a bore.

7. The suction roller as described in claim 1, wherein the control head has an aperture, and wherein a noise attenuating plate for atmospheric pressure equalization is disposed on the control head before said aperture, in the direction of rotation of said roller.

8. The suction roller as described in claim 7, wherein said noise attenuating plate has a groove broadening in a wedge-shaped manner towards said aperture.

9. the suction roller as described in claim 8, wherein said noise attenuating plate is made of a noise absorbing material.

10. The suction roller as described in claim 8, wherein said noise attenuating plate is made of a material with a noise attenuating surface.

11. The suction roller as described in claim 8, wherein said noise attenuating plate is made of a sintered material.

* * * * *